US009650878B2

(12) United States Patent
Patten

(10) Patent No.: US 9,650,878 B2
(45) Date of Patent: May 16, 2017

(54) CONVECTIVE FLOW BARRIER FOR HEATING OF BULK HYDROCARBONACEOUS MATERIALS

(71) Applicant: Red Leaf Resources, Inc., South Jordan, UT (US)

(72) Inventor: James W. Patten, South Jordan, UT (US)

(73) Assignee: Red Leaf Resources, Inc., Salt Lake City, UT (US)

( * ) Notice: Subject to any disclaimer, the term of this patent is extended or adjusted under 35 U.S.C. 154(b) by 0 days.

(21) Appl. No.: 14/444,665

(22) Filed: Jul. 28, 2014

(65) Prior Publication Data

US 2015/0027711 A1 Jan. 29, 2015

Related U.S. Application Data

(60) Provisional application No. 61/859,675, filed on Jul. 29, 2013.

(51) Int. Cl.
*E21B 43/24* (2006.01)
*E21B 43/241* (2006.01)

(52) U.S. Cl.
CPC ..... *E21B 43/24* (2013.01); *E21B 43/241* (2013.01)

(58) Field of Classification Search
CPC ..... E21B 43/24; E21B 43/2406; E21B 43/243
USPC ..... 166/302
See application file for complete search history.

(56) References Cited

U.S. PATENT DOCUMENTS

| | | | | |
|---|---|---|---|---|
| 3,455,392 | A * | 7/1969 | Prats | E21B 43/2406 166/303 |
| 3,468,376 | A | 9/1969 | Slusser et al. | |
| 5,221,827 | A | 6/1993 | Marsden, Jr. et al. | |
| 7,862,705 | B2 | 1/2011 | Dana et al. | |
| 7,980,312 | B1 * | 7/2011 | Hill | E21B 43/24 166/272.2 |
| 8,261,823 | B1 | 9/2012 | Hill et al. | |
| 8,267,481 | B2 | 9/2012 | Dana et al. | |
| 8,366,918 | B2 | 2/2013 | Dana et al. | |
| 8,596,357 | B2 | 12/2013 | Nenniger | |
| 2004/0120772 | A1 | 6/2004 | Vinegar et al. | |

(Continued)

FOREIGN PATENT DOCUMENTS

| | | |
|---|---|---|
| EP | 2396502 | 12/2011 |
| WO | WO 2010/093569 A2 | 8/2010 |
| WO | WO 2013/188646 A1 | 12/2013 |

OTHER PUBLICATIONS

PCT Application PCT/US2014/048475; filed Jul. 28, 2014; Red Leaf Resources; International Search Report; mailing date Nov. 14, 2014.

*Primary Examiner* — Catherine Loikith
(74) *Attorney, Agent, or Firm* — Thorpe North & Western, LLP

(57) ABSTRACT

A system for disrupting convective heat flow within a body of hydrocarbonaceous material includes a body of hydrocarbonaceous material which is sufficiently porous that convective currents can form in void spaces of the material. A bulk fluid occupies these void spaces and the bulk fluid is heated by a heat source, causing the bulk fluid to flow through the void spaces in convective currents. A convective barrier is placed in an upper portion of the body of hydrocarbonaceous material. This convective barrier is configured to disrupt convective flow of the bulk fluid.

21 Claims, 4 Drawing Sheets

(56) References Cited

U.S. PATENT DOCUMENTS

| | | | | |
|---|---|---|---|---|
| 2009/0250380 | A1 | 10/2009 | Dana et al. | |
| 2010/0200464 | A1 | 8/2010 | Dana et al. | |
| 2010/0200468 | A1* | 8/2010 | Dana | C10G 1/02 208/390 |
| 2010/0206410 | A1 | 8/2010 | Patten et al. | |
| 2011/0138649 | A1 | 6/2011 | Patten | |
| 2011/0286796 | A1 | 11/2011 | Patten | |
| 2011/0308801 | A1 | 12/2011 | Dana | |
| 2011/0313218 | A1 | 12/2011 | Dana | |
| 2013/0206270 | A1 | 8/2013 | Patten et al. | |
| 2013/0334106 | A1 | 12/2013 | Patten | |

* cited by examiner

CONVECTIVE FLOW BARRIER FOR HEATING OF BULK HYDROCARBONACEOUS MATERIALS

RELATED APPLICATION(S)

This application claims priority to U.S. Provisional Application No. 61/859,675, filed Jul. 29, 2013, which is incorporated herein by reference.

BACKGROUND

Global and domestic demand for fossil fuels continues to rise despite price increases and other economic and geopolitical concerns. As such demand continues to rise, research and investigation into finding additional economically viable sources of fossil fuels correspondingly increases. Historically, many have recognized the vast quantities of energy stored in oil shale, coal and tar sand deposits, for example. However, these sources remain a difficult challenge in terms of economically competitive recovery. Oil shale and tar sands in particular represent a tremendous volume of raw materials and remain a substantially underutilized resource. A large number of companies and investigators continue to study and test methods of recovering oil from such reserves. In the oil shale industry, for example, methods of extraction have included in-situ methods such as In-Situ Conversion Process (ICP) method (Shell Oil), combustion within steel fabricated retorts, and more recently constructed in-capsule methods such as the In-Capsule® Technology (Red Leaf Resources).

Among the various processes for extracting hydrocarbons from oil shale and tar sands, all face challenges in economics and environmental concerns. For example, some processes require a large energy input or consume a large volume of water. Other processes can create a risk of surface or ground water contamination or air pollution. Moreover, global warming concerns give rise to additional measures to address carbon dioxide ($CO_2$) emissions which are associated with such processes. An effective process should accomplish environmental stewardship, yet still provide high volume energy fuel output.

Large scale stationary constructed impoundments have recently been developed with the goal of addressing both the economic and environmental concerns inherent in extracting hydrocarbons from hydrocarbonaceous materials. These methods are currently known as EcoShale® In-Capsule® Technology and include forming a body of comminuted hydrocarbonaceous material encapsulated inside a fluid barrier. The hydrocarbonaceous material is usually rubbilized to allow for better combustion and heating permeability. Permeability is generally desired because pyrolysis, the method by which the hydrocarbons are extracted, can be achieved under high permeability conditions with greater quality and production with lower energy input. The fluid barrier can prevent the escape of liquids and vapors from the encapsulated volume, as well as avoid ingress of gases and liquids from outside sources. The hydrocarbonaceous material is heated inside the encapsulated volume, triggering pyrolysis to form flowable hydrocarbons and allowing their extraction.

Often in such processes, the fluid barrier is constructed from earthen materials such as clay, compacted fill, sand, or gravel. Large volumes can be encapsulated by using inexpensive earthen materials. In some arrangements the fluid barrier has multiple layers of materials that are chosen for their ability to restrict the movement of fluids into and out of the encapsulated volume. For example, in some processes the walls of the encapsulated volume are berms of compacted fill, with a layer of hydrated bentonite amended soil on the inner surfaces. The hydrated bentonite amended soil is generally effective at restricting movement of liquids and gases across the fluid barrier as long as hydration is maintained.

The fluid barrier contributes to making these processes more economic and environmentally safe. The processes can be optimized by controlling pressure, temperature, and chemical composition inside the encapsulated volume. This allows for higher volume fuel production with less energy input and water consumption. The fluid barrier also protects the environment by preventing pollutants from escaping. This solves problems with air pollution and surface and ground water contamination. For such processes to be effective the fluid barrier retains produced hydrocarbons inside the encapsulated volume for extraction and so materials do not escape into the environment in an uncontrolled manner.

SUMMARY

Unfortunately, these types of systems are not entirely static during operation such that fluid barriers can experience variations in exposure to heat which may degrade retention properties over time. It has been discovered that certain patterns of convective heat flow within such systems can damage the fluid barrier. In accordance with the present invention, a system for disrupting convective heat flow within a body of hydrocarbonaceous material includes the body of hydrocarbonaceous material and a convective barrier. The hydro carbonaceous material is sufficiently porous that convective currents can form in void spaces of the material. A bulk fluid can occupy these void spaces and is heated by a heat source, causing the bulk fluid to flow through the void spaces in convective currents. A convective barrier can be placed in an upper portion of the body of hydro carbonaceous material. This convective barrier can be configured and oriented to disrupt the convective flow of the bulk fluid. Disruption of the convective flow in upper portions of the body of hydrocarbonaceous material can be desirable for a variety of reasons as more fully outlined below.

There has thus been outlined, rather broadly, the more important features of the invention so that the detailed description thereof that follows may be better understood, and so that the present contribution to the art may be better appreciated. Other features of the present invention will become clearer from the following detailed description of the invention, taken with the accompanying drawings and claims, or may be learned by the practice of the invention.

Figure 1A:
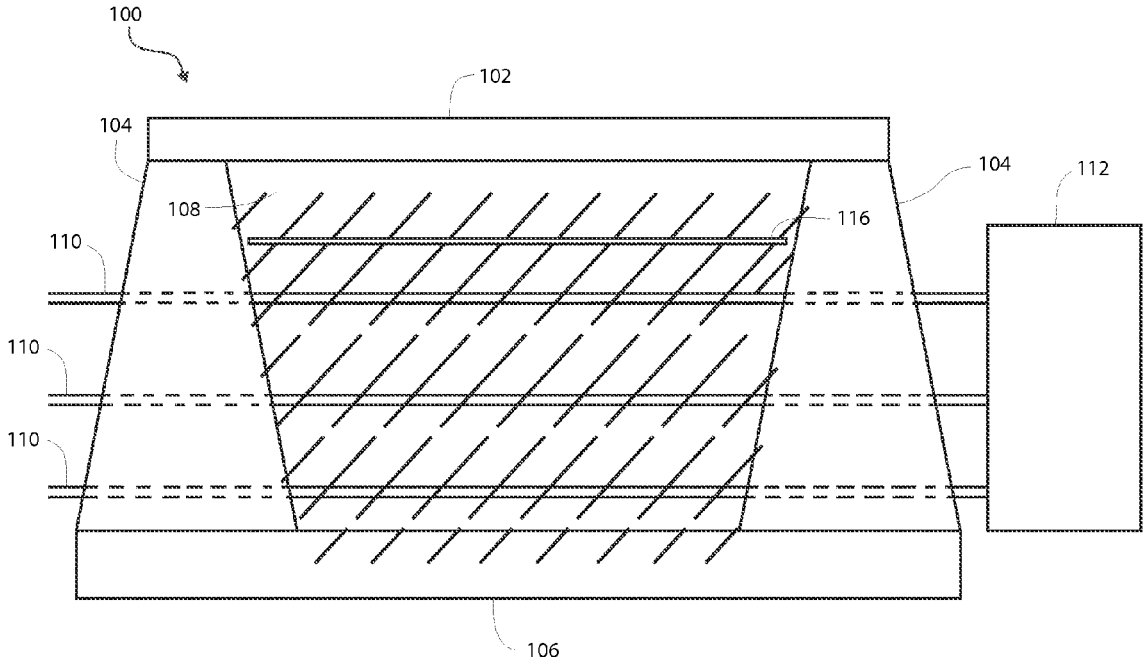
FIG. 1A is a side cross-sectional view of a system having embedded heating conduits in accordance with one embodiment of the present invention.

These drawings are provided to illustrate various aspects of the invention and are not intended to be limiting of the scope in terms of dimensions, materials, configurations, arrangements or proportions unless otherwise limited by the claims.

DETAILED DESCRIPTION

While these exemplary embodiments are described in sufficient detail to enable those skilled in the art to practice the invention, it should be understood that other embodiments may be realized and that various changes to the invention may be made without departing from the spirit and scope of the present invention. Thus, the following more detailed description of the embodiments of the present invention is not intended to limit the scope of the invention, as claimed, but is presented for purposes of illustration only and not limitation to describe the features and characteristics of the present invention, to set forth the best mode of operation of the invention, and to sufficiently enable one skilled in the art to practice the invention. Accordingly, the scope of the present invention is to be defined solely by the appended claims.

Definitions

In describing and claiming the present invention, the following terminology will be used.

As used herein, "hydrocarbonaceous material" refers to any hydrocarbon-containing material from which hydrocarbon products can be extracted or derived. For example, hydrocarbons may be extracted directly as a liquid, removed via solvent extraction, directly vaporized, by conversion from a feedstock material, or otherwise removed from the material. Many hydrocarbonaceous materials contain kerogen or bitumen which is converted to a flowable or recoverable hydrocarbon through heating and pyrolysis. Hydrocarbonaceous materials can include, but are not limited to, oil shale, tar sands, coal, lignite, bitumen, peat, and other organic rich rock. Thus, existing hydrocarbon-containing materials can be upgraded and/or released from such feedstock through a chemical conversion into more useful hydrocarbon products.

As used herein, "body of hydrocarbonaceous material" refers to any mass of hydrocarbonaceous material with distributed void space throughout the hydrocarbonaceous material. A body of hydro carbonaceous material suitable for use in this invention can have greater than about 10% distributed void space and typically has from about 20% to about 40% void space, although other ranges may be suitable depending on the specific hydrocarbonaceous material. A high distributed void space facilitates heating the body through convective heat transfer.

As used herein, "distributed void space" refers to empty space that occupies volumes throughout a body of hydrocarbonaceous material. In a crushed hydrocarbonaceous material, the void space is space between fragments of crushed material. The void space between a given fragment and its neighboring fragments can vary, depending on the size, shape, and positioning of the individual fragments. In a body of hydrocarbonaceous material with a high enough percentage of void space, for example, greater than about 10%, the voids between individual fragments can form a substantially continuous interconnected network of void space distributed throughout the body. This distributed void space can allow heating of the entire body by convective heat transfer. Further, a distributed void space can be uniformly distributed to avoid large non-uniform pockets of open voids.

As used herein, "bulk fluid" refers to a fluid occupying the distributed void space in a body of hydrocarbonaceous material. A bulk fluid suitable for the invention may be a single substance or a mixture of various substances. For example, the bulk fluid can contain air, hot gases, vaporized hydrocarbons, liquefied hydrocarbons, steam, entrained fines, dissolved compounds, dissolved minerals, or other substances. Further, the bulk fluid may be in any phase that would allow flow and transfer of heat throughout the body of hydrocarbonaceous material, such as liquid, vapor, gas, or supercritical phases. In the context of the present invention, bulk fluid flow is a macroscopic process by which the bulk fluid flows within the distributed void space throughout a body of hydrocarbonaceous material to create unique flow patterns. These bulk flow patterns are characteristic of the bulk fluid, temperature conditions, and configuration of the heating source and impoundment. The bulk flow patterns are distinct from microscopic movements of fluid, such as by diffusion, or the microscopic movements of individual molecules.

As used herein, "compacted earthen material" refers to particulate materials such as soil, sand, gravel, crushed rock, clay, spent shale, mixtures of these materials, and similar materials. A compacted earthen material suitable for use in the present invention typically has a particle size of less than about two inches in diameter. The material is compacted to increase its impermeability to fluids.

The singular forms "a," "an," and "the" include plural referents unless the context clearly dictates otherwise. Thus, for example, reference to "a particle" includes reference to one or more of such materials and reference to "subjecting" refers to one or more such steps.

As used herein with respect to an identified property or circumstance, "substantially" refers to a degree of deviation that is sufficiently small so as to not measurably detract from the identified property or circumstance. The exact degree of deviation allowable may in some cases depend on the specific context.

As used herein, a plurality of items, structural elements, compositional elements, and/or materials may be presented in a common list for convenience. However, these lists should be construed as though each member of the list is individually identified as a separate and unique member. Thus, no individual member of such list should be construed as a de facto equivalent of any other member of the same list solely based on their presentation in a common group without indications to the contrary.

Concentrations, amounts, and other numerical data may be presented herein in a range format. It is to be understood that such range format is used merely for convenience and brevity and should be interpreted flexibly to include not only the numerical values explicitly recited as the limits of the range, but also to include all the individual numerical values or sub-ranges encompassed within that range as if each numerical value and sub-range is explicitly recited. For example, a numerical range of about 1 to about 4.5 should be interpreted to include not only the explicitly recited limits of 1 to about 4.5, but also to include individual numerals such as 2, 3, 4, and sub-ranges such as 1 to 3, 2 to 4, etc. The same principle applies to ranges reciting only one numerical value, such as "less than about 4.5," which should be interpreted to include all of the above-recited values and ranges. Further, such an interpretation should apply regardless of the breadth of the range or the characteristic being described.

Any steps recited in any method or process claims may be executed in any order and are not limited to the order presented in the claims. Means-plus-function or step-plus-function limitations will only be employed where for a specific claim limitation all of the following conditions are present in that limitation: a) "means for" or "step for" is expressly recited; and b) a corresponding function is expressly recited. The structure, material or acts that support the means-plus function are expressly recited in the description herein. Accordingly, the scope of the invention should be determined solely by the appended claims and their legal equivalents, rather than by the descriptions and examples given herein.

System for Disrupting Convective Heat Flow

A system for disrupting convective heat flow within a body of hydrocarbonaceous material can include a convective heat flow barrier within the body.

The body of hydrocarbonaceous material can be a material from which useful hydrocarbon products can be recovered via processing such as heating under controlled conditions. FIG. 1A depicts a side cross-sectional view of one embodiment of the present invention. A fluid barrier 100 encapsulates the body of hydrocarbonaceous material 108 to prevent uncontrolled passage of fluids from the body. In the illustrated embodiment, the fluid barrier 100 includes a ceiling 102, walls 104, and a floor 106. In this embodiment the floor 106 and ceiling 102 are horizontal layers of compacted earthen material, while the walls 104 are berms of compacted earthen material. However, the fluid barrier can be formed in a wide variety of configurations as long as the body remains encapsulated and fluid transport across the fluid barrier can be controlled. Although smaller sizes can be formed, the body of hydrocarbonaceous material can often have a top plan area of 0.2 to 6 acres and a depth of about 3 to 100 meters.

Recovery of hydrocarbon products and other materials typically involves heating of the body of hydrocarbonaceous material 108. Heating can be accomplished using any suitable approach but can be accomplished via indirect heating using embedded heating conduits or directly using heated gases passed through the body of hydrocarbonaceous material. As illustrated in FIG. 1A, a plurality of heating conduits 110 can run through the body of hydrocarbonaceous material 108. In this embodiment the heating conduits are closed-loop, such that no heating fluid is transferred from the conduits 110 to the body 108. The heating conduits 110 carry heating fluid supplied by a heating fluid source 112 and heat is transferred into the body of hydrocarbonaceous material. As the hydrocarbonaceous material is heated, convective heat flows are produced which distribute heat throughout the body.

Figure 1B:
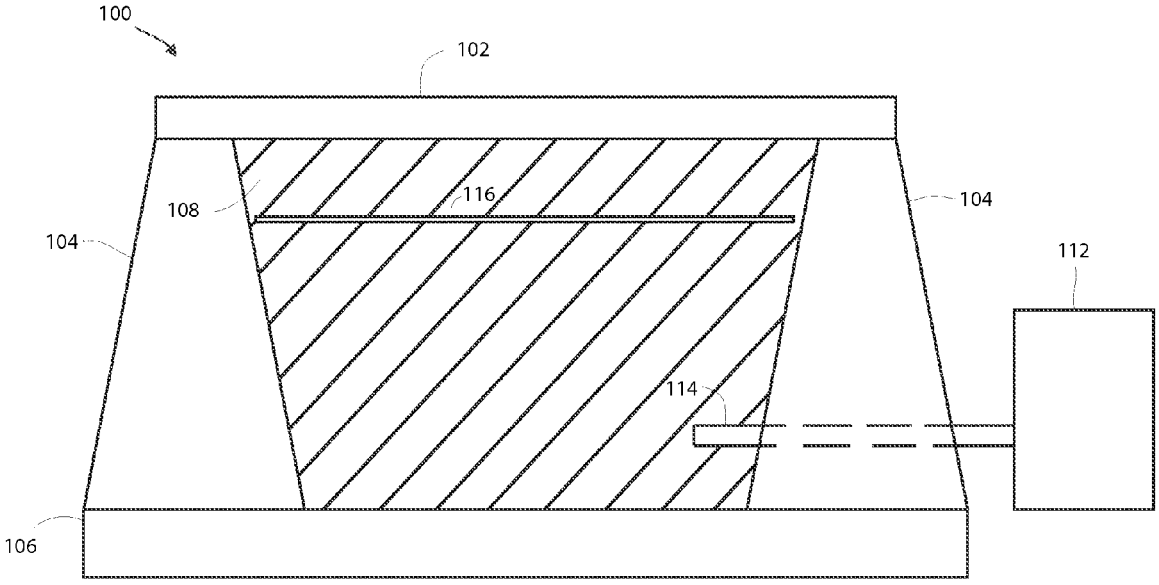
FIG. 1B is a side cross-sectional view of a system having direct heating in accordance with one embodiment of the present invention.

A convective barrier 116 can be placed near the ceiling 102 within an upper portion of the body of hydrocarbonaceous material 108. The barrier 116 is placed at a height where it will effectively disrupt harmful convective heat currents so heat does not degrade the ceiling 102 of the fluid barrier 100. FIG. 1B depicts an alternative embodiment, in which a hot gas injector 114 injects hot gases directly into the body of hydrocarbonaceous material 108. The hot gas can be supplied by a heating fluid source 112 which is also discussed in more detail below.

In order to facilitate heat distribution from the heating fluid source 112, the hydrocarbonaceous material can be sufficiently porous that void spaces are formed throughout the material as a substantially continuous network of void spaces. A bulk fluid can occupy these void spaces. The bulk fluid is heated by the heat source, causing the bulk fluid to flow through the void spaces in convective currents. Depending on the size of the body of hydrocarbonaceous material 108 and configuration of heating sources, the convective currents can become sufficiently substantial to create undesirable hot spots, especially in upper regions of the hydro carbonaceous material, and can even mechanically shift hydro carbonaceous materials and fluid barrier materials due to strong currents of mass flow drawn along in the convective currents. Accordingly, a convective barrier 116 can be placed in an upper portion of the body of hydrocarbonaceous material so as to disrupt such convectively driven heat and mass flows. This convective barrier can disrupt the convective flow of the bulk fluid, especially near upper portions of the hydrocarbonaceous material and any roof structures.

Voids within the body are of a size and sufficiently interconnected so that convective currents can cause a bulk fluid to flow within the distributed void space. The porosity of the body of hydrocarbonaceous material can allow convective flow throughout the whole body or a significant portion thereof. For example, convective currents can cause the bulk fluid to flow along recycling loops from lower portions of the body of hydrocarbonaceous material to the upper portions of the body.

In one embodiment of the present invention, the body of hydrocarbonaceous material can be comminuted hydrocarbonaceous material. Void space is largely a function of particle size and packing efficiencies. Most crushed materials will have irregular shapes which can facilitate lower packing efficiencies which correspond to relatively higher void space. Void spaces between fragments of crushed material can provide sufficient porosity to allow convective flow as long as particle size and packing are considered. The fragments of crushed hydrocarbonaceous material can have various average sizes.

However, as a general guideline, the average size of crushed material can be from about 0.3 cm to about 2 meters, in some cases from about 5 cm to about 60 cm, from about 16 cm to about 60 cm, with about 30 cm on average being especially useful for oil shale, although other size ranges can be suitable.

In an alternative aspect of the present invention, instead of crushed hydrocarbonaceous material, the body can contain a hydrocarbonaceous material with sufficient natural porosity to allow convective flow. Alternatively, other means can be used to increase the porosity of the hydrocarbonaceous material such as porous filler material, fracturing, multimodal size distributions, selective packings, and the like. In general, the hydrocarbonaceous material can be a particulate material which is substantially stationary, even during processing. Although subsidence and settling may occur, the hydrocarbonaceous material remains within the fluid barrier throughout the process. Accordingly, the process is further typically a batch process.

In the body of hydrocarbonaceous material, a percentage of the volume of the body can be distributed as the void space. Desirable void space can vary depending on the type of hydrocarbonaceous material, process conditions, and other factors. However as a general guideline, the distributed void space can be from about 10% to about 65% of the total volume of the body of hydrocarbonaceous material. Other percentages may also be suitable, such as about 10% to about 30%, about 10% to about 20%, about 20% to about 30%, about 20% to about 40%, or about 30% to about 40%. In one embodiment, the body of hydrocarbonaceous material can be a crushed hydrocarbonaceous material, and the percentage of void space can depend on the size, shape, and positioning of fragments of crushed hydrocarbonaceous material. Unless otherwise enunciated, these void space volumes are relative to initial starting conditions prior to processing. Further, the void space is typically evenly distributed throughout the hydrocarbonaceous material. Specifically, non-uniform pockets of void space or material can be avoided to form substantially uniform distribution of voids and particulate material.

Depending on the particular material, settling and void space reduction can occur during heating as hydrocarbons and other components are removed from the hydrocarbonaceous material. Consolidation and compaction occurs as individual particles lose at least some structural integrity upon liberation of components from the original feedstock hydrocarbonaceous material. The degree of compaction will depend largely on the type and quality of feedstock, as well as process conditions. Furthermore, it is generally desirable to avoid compaction during formation of the system. Lithostatic pressure will arise as hydrocarbonaceous materials are deposited; however compaction can be reduced by dumping materials as close as possible to a surface as hydrocarbonaceous materials are laid down. Similarly, movement of heavy machinery across top surfaces of the hydrocarbonaceous material during and after formation of the body can be reduced or eliminated.

As previously mentioned, a wide variety of hydrocarbonaceous material can be processed using the present invention. Suitable hydrocarbonaceous material can be any material from which valuable hydrocarbons can be liberated (i.e. released and/or produced). For example, the body of hydrocarbonaceous material can include oil shale, tar sands, coal, bitumen, peat, biomass, or combinations thereof. The convective flow within the body of hydrocarbonaceous material is especially effective for extracting high quality hydrocarbons from materials containing kerogen and bitumen, which are converted to more valuable hydrocarbons through pyrolysis. In one embodiment, for example, the body of hydrocarbonaceous material includes crushed oil shale. Oil shale and other hydrocarbonaceous materials can vary considerably in composition. Thus, oil shale mined from one location may differ substantially from oil shale mined in a separate location. Differences can range from organic content, mineral type, sulfur content, fines content, and the like. Each of these differences can contribute to variations in heating rates, recovery rates, ratios of liquid to gas production, and hydrocarbon product quality.

In some embodiments of the present invention, the body of hydro carbonaceous material is encapsulated by the fluid barrier as previously discussed. The fluid barrier can be configured to prevent unwanted mass transfer of materials into and out of the encapsulated volume, especially during the heating process. The fluid barrier can thus prevent leaking of hydrocarbons out of the body of hydrocarbonaceous material and the resultant loss of valuable product. Also, hydrocarbonaceous materials may contain or otherwise liberate non-hydrocarbon components during the hydrocarbon extraction process. The fluid barrier can prevent harm to the environment by preventing such components from seeping out of the body of hydrocarbonaceous material into surrounding air, water, or soil. In some embodiments the body of hydrocarbonaceous material can be placed under positive pressure of less than about 20 psi, in some cases less than 5 psi and most often less than 2 psi. In such embodiments the fluid barrier can prevent gases from leaving or entering the body during operation such that a pressure difference across the fluid barrier can be maintained.

As illustrated generally in FIG. 1A, the fluid barrier 100 in accordance with the present invention can comprise a floor 106, walls 104, and a ceiling 102. The floor, walls, and ceiling can be joined so that they substantially encapsulate the body of hydrocarbonaceous material. The fluid barrier can also be formed of any material that sufficiently blocks mass transfer into and out of the body of hydrocarbonaceous material. In one embodiment, the fluid barrier can be compacted earthen material. The compacted earthen material can include particulate materials such as soil, sand, gravel, clay (e.g. swellable clays such as bentonite, montmorillonite, kaolinite, illite, chlorite, vermiculite, etc), crushed rock, and similar materials. For example, in one embodiment of the present invention, the compacted earthen material can be spent oil shale that has been crushed to a small size and compacted. A compacted earthen material suitable for use in the present invention typically has a particle size of less than about two inches in diameter. Such compacted earthen materials can be amended to optionally include secondary materials and/or liquid phases. Secondary materials can include synthetic additives, while liquid phases can generally include water. However, a liquid phase comprising materials such as oils, waxes, and the like can also be used.

Earthen materials can be compacted to increase their impermeability to fluids. For example, earthen materials can be compacted through natural settling after dumping, tamping, or applying pressure to the earthen materials. In one embodiment of the present invention, the walls of the fluid barrier can be berms of earthen materials. First, a floor of compacted earthen material can be formed over an area. Berms of earthen material can then be formed by dumping earthen material around the sides of the area and then compacting the material. Typically, such walls will have sloped sides which generally correspond to a native angle of repose for the particulate earthen material. Hydrocarbonaceous material can then be added to the volume inside the berms, forming the body of hydrocarbonaceous material. Alternatively, the hydrocarbonaceous material can be added simultaneously as the berms or walls are formed. This can allow for variations in wall thicknesses which are not dependent on the angle of repose for unsupported particulate material. Finally, a layer of earthen material can be added to the top of the body of hydrocarbonaceous material to form the ceiling. Thus, the body of hydrocarbonaceous material can be encapsulated by the fluid barrier. Other suitable methods of constructing a fluid barrier can also be used. Optional materials such as plastic liners, metal sheets, or other layers can be provided to supplement fluid containment properties of the fluid barrier.

The fluid barrier can often be formed of clay optionally amended with soil. Suitable clays can include, but are not limited to, swelling clays such as bentonite clay, montmorillonite, kaolinite, illite, chlorite, vermiculite, and the like. Such clays can provide a continuous liquid phase throughout a solid phase when hydrated. In one embodiment of the present invention, the fluid barrier can comprise bentonite-amended soil. Bentonite-amended soil can be hydrated, causing the bentonite particles to partially expand while water fills gaps between soil particles and the bentonite particles. The hydrated bentonite-amended soil can be an effective impermeable barrier to fluids including a solid phase of bentonite and soil along with a liquid phase filling voids within a bentonite-soil matrix. In some embodiments of the present invention, the fluid barrier can include multiple layers of different materials. For example, the barrier can include a layer of bentonite-amended soil and a layer of crushed oil shale. Various combinations of materials can be used to adjust and optimize levels of impermeability to fluids and structural strength in the fluid barrier based on the size of the entire structure and specific materials used. Fluid barrier properties can be maintained by maintaining hydration. This can be accomplished by rehydration during operation and/or by designing the fluid barrier to have a sufficient thickness to avoid dehydration and loss of fluid control during processing.

A fluid barrier in accordance with the present invention can include inlets and outlets for addition to or removal of substances from the body of hydrocarbonaceous material. For example, outlets for hydrocarbons can allow recovery of valuable products in a liquid, gaseous and/or vapor state. The outlets can lead to pipes or other equipment for containing removed components such as hydrocarbons so that the hydrocarbons can be recovered while still preventing leakage of pollutants into the environment. Similarly, inlets can be used to introduce substances into the body of hydrocarbonaceous material. For example, water, steam, solvents, or heating gases can be introduced through inlets. In some embodiments, heating conduits can enter and exit the body of hydrocarbonaceous material at designated locations. The inlets and outlets can be formed with a fluid-tight interface between the fluid barrier and the conduits so that substantially no unwanted leakage through the fluid barrier occurs along the interface. Thus, the invention can provide for controlled addition and removal of substances to and from the body of hydrocarbonaceous material while the body remains substantially encapsulated by the fluid barrier. During removal of products, subsidence and settling of the hydrocarbonaceous material can occur. However, the hydrocarbonaceous material remains within the fluid barrier throughout the process. Accordingly, the process is also typically a batch process.

The system for disrupting convective heat flow within the body of hydrocarbonaceous material includes the heat source 112 which can be configured to induce convective flow in the bulk fluid. In one embodiment of the invention, the heat source can provide sufficient heat to cause pyrolysis of kerogen in oil shale. Generally, sufficient heat can be introduced to liberate at least portions of the hydrocarbonaceous material as more useful hydrocarbon products. The heat source induces the convective currents, which in turn can facilitate production of hydrocarbons by creating a favorable temperature profile within the body. Convective flow of the bulk fluid allows hot fluid to contact fragments of oil shale, for example, throughout a substantial portion of the body of oil shale, even if the fragments are relatively distant from the heat source. Convective heat transfer coefficients can also be greater than conductive heat transfer coefficients. Therefore, convective flow of the bulk fluid can heat the body more efficiently than conduction alone.

In some embodiments of the present invention, the heat source 112 can be oriented within the body of hydrocarbonaceous material. Specifically, the heat source can include one or more heating conduits embedded in the body of hydrocarbonaceous material. The conduits can be formed of any suitable material, including clay pipes, refractory cement pipes, refractory ECC pipes, poured in place pipes, metal pipes such as cast iron, carbon steel, stainless steel, etc., polymer such as PVC, and other suitable materials. The heating conduits can be oriented in any configuration, whether substantially horizontal, vertical, slanted, branched, or the like. In some embodiments, the heating conduits can be oriented along predetermined pathways that are designed to improve heat transfer throughout the body of hydrocarbonaceous material. For example, in one embodiment a plurality of heating conduits can be oriented substantially horizontally and spaced apart vertically. Convective currents can form around the heating conduits, improving heat transfer to the body of hydrocarbonaceous material. The heating conduits can be oriented beneath the convective barrier so that convective currents that are induced by the heating conduits can be disrupted by the convective barrier. Most often, at least some heating conduits will be located in lower portions of the body.

The heat source can optionally include a closed-loop system of heating conduits 110 as illustrated generally in FIG. 1A. A heat transfer fluid can flow through the conduits from the heat source 112, heating the body of hydrocarbonaceous material without heat transfer fluid coming in contact with the hydrocarbonaceous material 108. The heat transfer fluid can be any fluid which is capable of transferring heat into the body and can include, but is not limited to, water, combustion gases, steam, paraffin oils, glycol based fluids, silicone based fluids, mineral oils, and combinations of these materials. In the embodiment illustrated in FIG. 1B, the heat source 112 can inject a heating fluid directly into the body of hydrocarbonaceous material 108. In one embodiment, the heat source can include a hot gas injector 114. The hot gas injector can be oriented to inject hot gas in a direction that reinforces useful convective currents in the body of hydrocarbonaceous material. In other alternative embodiments, the heat source can include combustion of a portion of the body of hydro carbonaceous material.

A system for disrupting convective heat flow within a body of hydrocarbonaceous material also includes the bulk fluid. The bulk fluid occupies the void space in the body of hydrocarbonaceous material. The bulk fluid can be a single substance or a mixture of various substances. For example, the bulk fluid can contain air, hot gases, vaporized or liquefied hydrocarbons, water, steam, or other substances such as solid fines or debris. The bulk fluid can originate in the body of hydrocarbonaceous material or it can be an additive injected through an inlet in the fluid barrier. Further, the bulk fluid may be in any phase that would allow flow, such as liquid, vapor, gas, or supercritical phases. In one embodiment, the bulk fluid can include liquefied and vaporized hydrocarbons that are produced from the hydrocarbonaceous material. These hydrocarbons can act as an in-situ formed solvent to facilitate further removal of hydrocarbons from the hydrocarbonaceous material. Further, the bulk fluid can act as the primary mechanism for heat distribution throughout the body of hydrocarbonaceous material. As discussed, the bulk fluid receives heat from the heat source, and in some cases from exothermic reactions during production.

Heated bulk fluid generally rises through the void space. Based on the location of any heating conduits, the size of the system and other factors, the rising heated bulk fluid experiences convective flow patterns. In some cases, these convective flow patterns can be generally circular recycling flow patterns where heated bulk fluid rises toward the ceiling releases heat into the surrounding fluid barrier, and circulates back toward lower portions of the body. Depending on heat transfer rates, heat can accumulate in the ceiling of the fluid barrier sufficient to reduce fluid retention properties of the fluid barrier. For example, a hydrated BAS layer may become dehydrated upon exposure to sufficient heat over a sufficient period of time. These convective patterns can also create local points of higher pressure and temperature. Local areas of higher pressure can potentially cause the walls around the encapsulated volume to shift, bulge and rupture, leading to unrestricted escape of gases and liquids. Such events are typically most likely to occur at the top of the encapsulated volume, where hot convective updrafts flow from the body of hydrocarbonaceous material, penetrating into the fluid barrier. Such convective flow can cause physical upward pressure as well as localized hot spots within the body. In some cases, these local "hot spots" can cause degradation and/or dehydration of the fluid barrier encapsulating the body of hydrocarbonaceous material. Thus, in some circumstances, the fluid barrier can be degraded to a point that it no longer effectively restricts movement of fluids across the barrier.

It has been recognized that one solution to protect the fluid barrier, especially the ceiling, is to introduce the convective barrier 116 within the body of hydrocarbonaceous material 108, as illustrated in FIG. 1A. The convective barrier can be located in an upper portion of the body of hydrocarbonaceous materials. Generally, convective flow can be helpful to distribute heat and gaseous products throughout the body of hydrocarbonaceous material. Further, such convective flow can be used to achieve an efficient temperature profile throughout the body of hydrocarbonaceous material for production of hydrocarbons. However, the present invention facilitates productive convective flow while avoiding excessive degradation of the fluid barrier around the encapsulated volume. The convective barrier disrupts convective flow so as to reduce or eliminate hot spots that degrade the fluid barrier. Convective flow can continue to occur freely within a primary portion of the body of hydro carbonaceous material that is beneath the convective barrier.

The convective barrier can be positioned at a height that effectively disrupts harmful convective flow adjacent the ceiling 102. In accordance with one aspect of the present invention, the convective barrier 116 can be placed near or within the body of hydrocarbonaceous material 108 at a height that effectively protects the top portion of the fluid barrier 100 from harmful convective flow, while at the same time allowing useful convective flow below the convective barrier. Such a height can be between about 65% and about 100% of the height of the body of hydrocarbonaceous material. Other heights may also be suitable, such as between about 70% and about 90%, between about 80% and about 90%, at about 80%, or at about 90% of the height of the body of hydrocarbonaceous material. In one aspect, the convective barrier can be oriented at or near (e.g. within 0.6 meter) the interface between the hydrocarbonaceous material and the ceiling.

The convective barriers can be formed and configured to avoid damage to the fluid barrier 100 during operation. Typically, this means keeping the upper region of the body adjacent the fluid barrier less than about 100° C. for hydrated BAS. However, generally, the upper region of the body adjacent the fluid barrier can be maintained at least about 6° C. below a maximum fluid barrier threshold temperature. The maximum fluid barrier threshold temperature is a temperature beyond which integrity of the fluid barrier cannot be maintained during expected operational times. The threshold temperature can vary considerably depending on the specific composition of the fluid barrier. For example, an oil impregnated soil matrix as the fluid barrier may have a higher threshold temperature than a water impregnated matrix. Regardless, disruption of the convective flow in this upper region can be accomplished by configuring the convective barrier to block at least a portion of mass flow across the convective barrier.

Figure 2A:
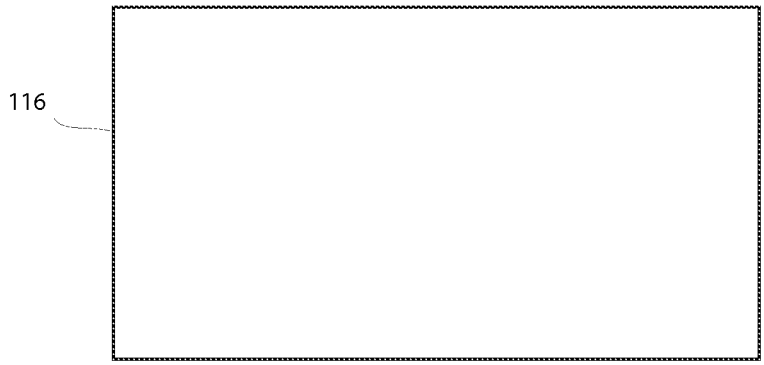
FIG. 2A is a top plan view of a solid sheet convective barrier in accordance with one embodiment of the present invention.

Convective barriers can be a contiguous solid sheet material, a porous material, or may be segmented. For example, the convective barrier 116 can be formed from a nonporous, contiguous material as illustrated in FIG. 2A. Because such a convective barrier is essentially a solid layer without holes or openings to allow fluid to flow through, if such a barrier is placed in the path of a convective current, it can completely block all convective flow and mass transfer. Heating above such a convective barrier would involve conductive heat flow through the barrier followed by renewed creation of convective heating which starts in the upper region. The convective barrier can optionally extend horizontally across substantially the entire body of hydrocarbonaceous material, thereby blocking bulk convective flow from a primary production portion of the body of hydrocarbonaceous material from reaching the ceiling of the fluid barrier.

Further, the convective barrier can comprise various materials and configurations. In embodiments having a nonporous, contiguous convective barrier, the barrier can be formed from such materials as sheet metal, foil, cement, polymer sheets, and other nonporous materials. The convective barrier need not completely cover the entire body of hydrocarbonaceous material to be effective, as long as sufficient blocking surface area is provided to disrupt bulk convective flow patterns.

Figure 2B:
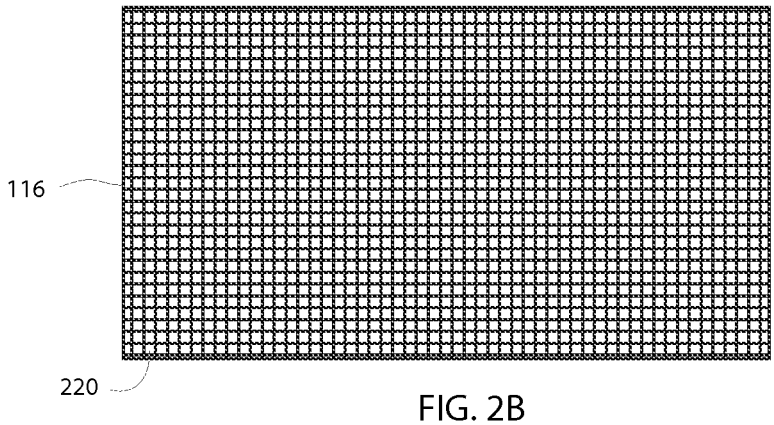
FIG. 2B is a top plan view of a mesh convective barrier in accordance with one embodiment of the present invention.

In some embodiments of the present invention, the convective barrier can be formed from a porous material with a portion of open surface area distributed across the barrier. FIG. 2B depicts a barrier 118 formed from a mesh material. This barrier 118 has a portion of open surface area distributed across the barrier, in the form of mesh openings 220. Such convective barriers provide blocking surfaces which are sufficient to disrupt bulk convective flow patterns while still allowing mass transfer into upper portions of the body. For example, the convective barrier can be a wire mesh, perforated sheet, screen, lattice, net, textile, or other porous material. Such a convective barrier can disrupt convective flow sufficiently to prevent damage to the fluid barrier while allowing some amount of convective flow through to effectively heat the hydrocarbonaceous material above the convective barrier.

In one embodiment, the convective barrier can be a wire mesh with a mesh size of between about 1 mm and about 10 mm, although other mesh sizes may be suitable. A nonporous material such as sheet metal can also be made porous by forming a plurality of holes to form a portion of open surface area. In some embodiments the open surface area in the convective barrier can be distributed throughout the barrier. In most cases, the open surface area can be distributed substantially evenly across the convective barrier. For example, wire mesh or screen can have uniformly sized apertures spaced evenly throughout. In alternative embodiments, open surface area can be distributed in a predetermined pattern that most efficiently disrupts harmful convective currents. For example, a piece of sheet metal with perforated holes can have larger or more densely spaced holes in areas where the convective current is weaker, and smaller or fewer holes in areas where the convective current is stronger and more blocking surface is needed to sufficiently disrupt convective flow. Generally, a porous convective barrier can have various percentages of open surface area. In some embodiments, the convective barrier can have from about 80% to about 95% open surface area. Other percentages of open surface area may also be suitable as long as convective flow patterns are disrupted sufficiently to protect upper portions of the ceiling and fluid barrier. Regardless of the particular convective barrier configuration, thicknesses can often vary from about 1 mm to about 1 cm. Thickness can vary but is sufficient to maintain structural integrity during processing, while avoiding excessive thickness which can increase costs.

Figure 2C:
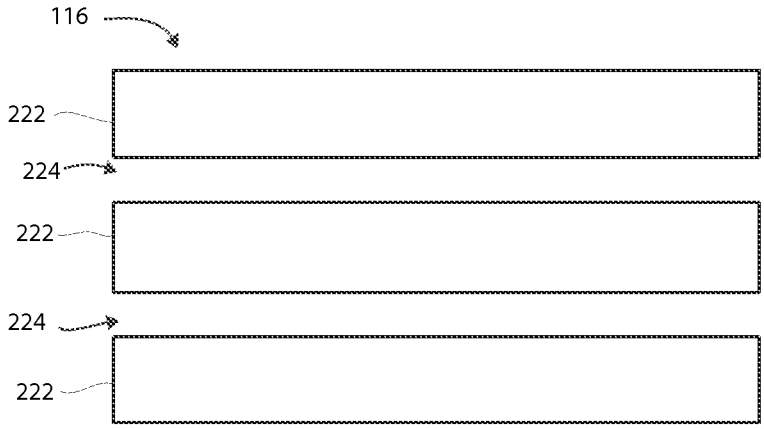
FIG. 2C is a top plan view of a segmented convective barrier in accordance with one embodiment of the present invention.

In yet other alternative embodiments, the convective barrier can have multiple planar pieces distributed throughout the body of hydrocarbonaceous material with open spaces between the planar pieces. Such segmented convective barriers can be spaced vertically and/or horizontally in order to create variations in convective flow patterns. FIG. 2C depicts a top plan view of a barrier 120 with multiple planar pieces 222 which are horizontally spaced apart. The planar pieces 222 are distributed with open spaces 224 between them to allow convective flow to follow a serpentine path past the barrier. FIG. 2D is a side view of yet another embodiment where convective barrier 122 includes multiple segments 226 which are vertically spaced to allow horizontal overlapping. In this case, convective flows will impact bottom surfaces of the segments 226 and convective flow would then proceed around edges in a serpentine path 228 between adjacent segments. Regardless, the pieces can be placed in predetermined positions to effectively disrupt harmful convective currents based on a specific heating configuration. For example, the pieces can be placed in the direct path of hot updrafts, while the open spaces between the pieces can be over cooler downdrafts. In one embodiment, heating conduits can be oriented substantially horizontally and spaced apart vertically, which can create convective updrafts between rows of conduits. The convective barrier can include multiple pieces oriented over the spaces between the rows of conduits where hot updrafts form. The planar pieces of the convective barrier can be formed from nonporous, contiguous materials, or porous materials with a portion of open surface area.

In an alternative embodiment, the convective barrier can comprise a layer of earthen material, such as fines, sand, gravel, or combinations thereof. The earthen material of the convective barrier can be porous, but less porous than the body of hydro carbonaceous material so that convective currents will not pass through the convective barrier as easily as through the body of hydrocarbonaceous material. In one embodiment, a layer of crushed oil shale with an average particle size of less than five centimeters can be used.

Figure 3:
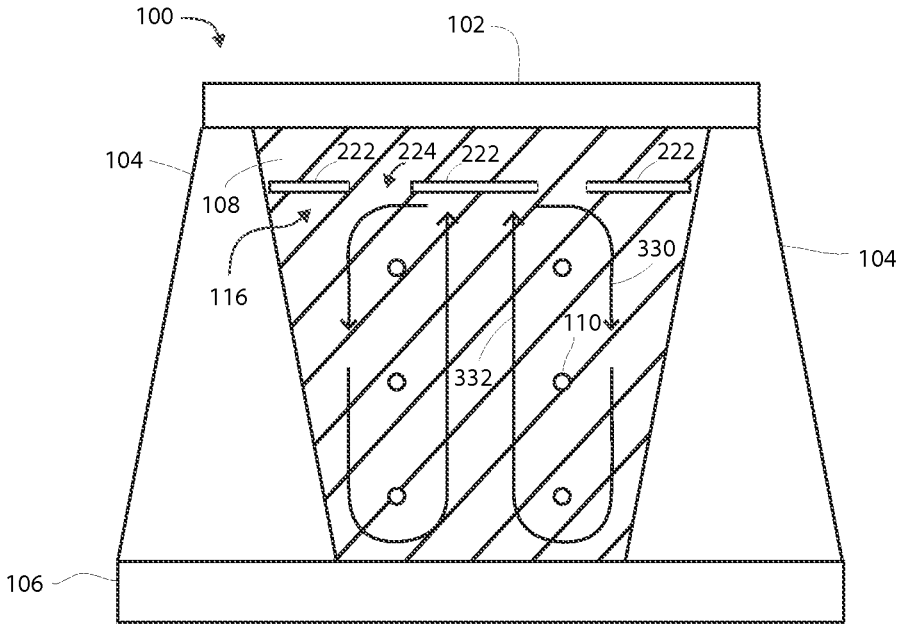
FIG. 3 is an end cross-sectional view of a system in accordance with one embodiment of the present invention.

FIG. 3 depicts an end cross-sectional view of an embodiment of the present invention. Heating conduits 110 are shown end-on extending through the body of hydrocarbonaceous material 108. Convective updrafts 332 form between the rows of conduits 110, and convective downdrafts 330 form between the rows of conduits 110 and the walls 104. The convective barrier 124 in this embodiment has three planar pieces 222. The planar pieces 222 are positioned so that they block the convective updrafts 332, while the open spaces 224 in the barrier 122 are positioned generally over the convective downdrafts 330.

Figure 4:
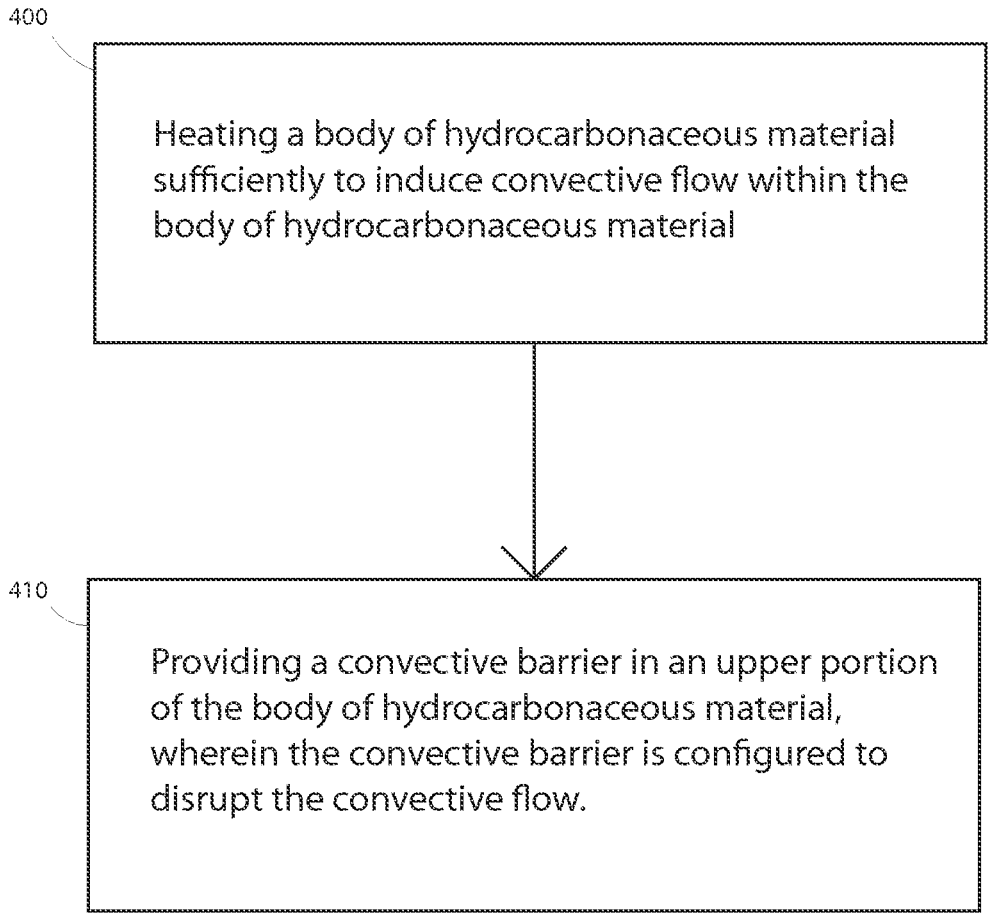
FIG. 4 is a process flow diagram of a method in accordance with one embodiment of the present invention.

FIG. 4 depicts a method in accordance with the present invention for disrupting convective heat flow within a body of hydrocarbonaceous material. The method includes a step 400 of heating a body of hydrocarbonaceous material sufficiently to induce convective flow within the body of hydrocarbonaceous material; and a step 410 of providing a convective barrier in an upper portion of the body of hydrocarbonaceous material, wherein the convective barrier is configured to disrupt the convective flow.

The foregoing detailed description describes the invention with reference to specific exemplary embodiments. However, it will be appreciated that various modifications and changes can be made without departing from the scope of the present invention as set forth in the appended claims. The detailed description and accompanying drawings are to be regarded as merely illustrative, rather than as restrictive, and all such modifications or changes, if any, are intended to fall within the scope of the present invention as described and set forth herein.

What is claimed is:

1. A system for disrupting convective heat flow within a body of hydrocarbonaceous material comprising:

a) a body of hydrocarbonaceous material having a distributed void space therein with sufficient porosity to allow convective flow within the void space;

b) a bulk fluid oriented in the void space of the body of hydrocarbonaceous material;

c) a heat source configured to induce convective flow of the bulk fluid; and d) a convective barrier oriented within an upper portion of the body of hydrocarbonaceous material configured to disrupt the convective flow; and e) a fluid barrier substantially encapsulating the body of hydrocarbonaceous material, wherein the convective barrier is within the fluid barrier and protects a top portion of the fluid barrier from convective flow while allowing convective flow below the convective barrier.

2. The system of claim 1, wherein the body of hydrocarbonaceous material comprises substantially stationary crushed hydrocarbonaceous material having an average size from about 2.5 cm to about 60 cm.

3. The system of claim 1, wherein the distributed void space is evenly distributed throughout the total volume and comprises from about 10% to about 65% of the total volume of the body of hydrocarbonaceous material.

4. The system of claim 1, wherein the body of hydrocarbonaceous material comprises at least one of oil shale, tar sands, coal, bitumen, peat, and biomass.

5. The system of claim 1, wherein the body of hydrocarbonaceous material comprises oil shale.

6. The system of claim 1, wherein the fluid barrier comprises compacted earthen material.

7. The system of claim 1, wherein the fluid barrier comprises clay amended soil.

8. The system of claim 1, wherein the bulk fluid comprises hydrocarbons produced from the hydrocarbonaceous material.

9. The system of claim 1, wherein the heat source is oriented within the body of hydrocarbonaceous material.

10. The system of claim 1, wherein the heat source comprises a plurality of heating conduits embedded within the body of hydrocarbonaceous material.

11. The system of claim 10, wherein all of the heating conduits are beneath the convective barrier.

12. The system of claim 1, wherein the heat source comprises at least one hot gas injector.

13. The system of claim 1, wherein the convective barrier is located at a barrier height 70% to 90% of a total height of the body of hydrocarbonaceous material.

14. The system of claim 1, wherein the convective barrier comprises a nonporous, contiguous layer extending horizontally across substantially the entire body of hydrocarbonaceous material.

15. The system of claim 1, wherein the convective barrier comprises a porous material having a portion of open surface area distributed throughout the convective barrier.

16. The system of claim 15, wherein the portion of open surface area is uniformly distributed.

17. The system of claim 1, wherein the convective barrier comprises a material selected from the group consisting of sheet metal, foil, screen, wire mesh, net, textile, and combinations thereof.

18. The system of claim 1, wherein the convective barrier comprises multiple planar pieces distributed throughout the body of hydrocarbonaceous material and open spaces between the planar pieces.

19. The system of claim 18, wherein local updrafts form within the body of hydrocarbonaceous material and the multiple planar pieces of the convective barrier are oriented in the paths of the updrafts.

20. The system of claim 1, wherein the convective barrier is oriented within 0.6 meter of an interface between the hydrocarbonaceous material and a ceiling of the fluid barrier.

21. A method for disrupting convective heat flow within a body of hydrocarbonaceous material comprising the steps of:

a) heating a body of hydrocarbonaceous material sufficiently to induce convective flow within the body of hydrocarbonaceous material, wherein the body of hydrocarbonaceous material is substantially encapsulated by a fluid barrier; and b) providing a convective barrier in an upper portion of the body of hydrocarbonaceous material, wherein the convective barrier is configured to disrupt the convective flow to protect a top portion of the fluid barrier from convective flow while allowing convective flow below the convective barrier.

* * * * *